United States Patent [19]

Voight

[11] 4,126,253

[45] Nov. 21, 1978

[54] CLOTHES HANGER ADAPTER

[76] Inventor: Larry A. Voight, 142 W. 41st Ave., San Mateo, Calif. 94403

[21] Appl. No.: 814,224

[22] Filed: Jul. 11, 1977

[51] Int. Cl.[2] ..... A47J 51/12

[52] U.S. Cl. ..... 223/98

[58] Field of Search ..... 223/91, 96, 88, 92, 223/85, 98, 95; 211/113, 123, 124

[56] References Cited

U.S. PATENT DOCUMENTS

| | | | |
|---|---|---|---|
| 546,492 | 9/1895 | Millert | 223/91 X |
| 1,272,164 | 7/1918 | Williams | 223/88 |
| 2,464,324 | 3/1949 | Levin | 223/91 |
| 2,710,124 | 6/1955 | Laureyer | 223/88 |
| 3,512,228 | 5/1970 | Carvell | 223/96 |

*Primary Examiner*—George H. Krizmanich
*Attorney, Agent, or Firm*—Henry G. Kohlmann

[57] ABSTRACT

This invention relates generally to various devices used to hang clothes. More specifically, it relates to a clothes hanger adapter for wire hangers which comprises a tube adapted for receiving the lower hanger bar of a conventional wire hanger. Slidably attached to said tube are at least two hanger hook adapted for receiving the tube and adjustable longitudinally thereof such that the hook portions engage clothes draped on said hanger and prevent the same from falling therefrom. Once in place on the hanger, said tube cannot be dislodged but must be removed or installed in a specified manner.

10 Claims, 4 Drawing Figures

CLOTHES HANGER ADAPTER

BACKGROUND OF THE INVENTION

1. Field of the Invention

The field of this invention is generally related to devices used for hanging clothes and specifically devices used for hanging clothes that provide means for preventing the same from slipping off the hanger and for preventing wrinkles and creases in the clothes so hung.

2. Description of the Prior Art

Tubes for ordinary wire hangers having a substantially greater diameter than the wire of said hanger have been within the knowledge of those having skill in the prior art for many years. Even to the extent of providing slits therein to allow receipt of the wire hanger into said slit as is typified by U.S. Pat. No. 2,023,443 by *Rodgers* FIG. 4. In addition, hanger hooks of the kind described herein have also been well known in the prior art and are typified by U.S. Pat. No. 3,419,239 by *Ginther,* FIG. 1. However, there is an inherent problem with the tubular members as described in *Rodgers* in that should the tube rotate while the clothing is draped over the tube, it may rotate such that the slit which allows insertion of the wire hanger aligns with the lower bar of the hanger, the very weight of the clothes causes the tube to expell the hanger and drop free thereof while the clothing remains hanging in place, thereby defeating the entire purpose of adding the tube in the first instance namely the prevention of creases and wrinkles.

*Ginther* on the other hand recognized this problem and has provided a device with a transverse slit so that the weight of the clothes or the rotation of the tubular portion of the device disclosed therein cannot cause alignment of the slit with the wire or the expelling of the wire from the device. However, *Ginther* still does not prevent the creasing of or introduction of wrinkles in the clothes hung on the device.

The above problems have been solved by the instant invention wherein it is the object thereof to provide a device which allows a tubular member to be added to the lower wire of an ordinary wire hanger but which cannot expell the lower wire of said hanger.

Another object of this invention is to provide a device which will provide hooks for engaging ties, pants, skirts, and the like and holding them in a fixed position longitudinally of said hanger.

Another object of this invention is to provide a device for attachment to a hanger which not only provides a large diameter tube but also provides clips which may be positioned either above or below said tube according to the specific purpose of the user but also provides clips thereon which are adjustable longitudinally of said tube.

PREFERRED EMBODIMENT

Figure 1:
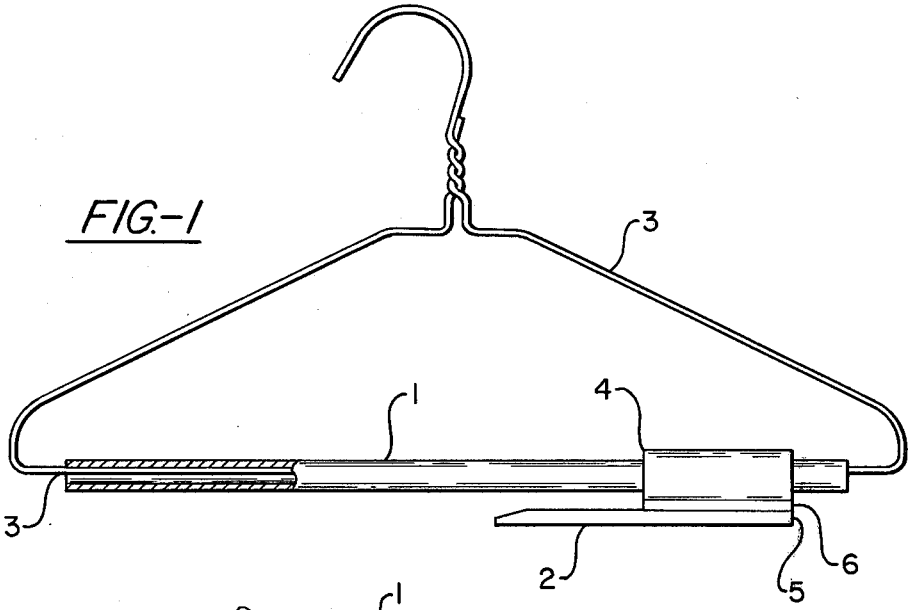
FIG. 1 is a partial sectional side view of said attachment showing both the tube and clip in position on said hanger.

With reference to the drawings, FIG. 1 shows an elongated tubular member 1 having a clip 2 adjustable longitudinally attached thereto both being attached to an ordinary wire hanger in a preferred operating position. Said elongated tube 1 is provided with a slit therein which extends the full length thereof and allows the insertion of the lower portion of a wire hanger 3. It is preferred that said tubular member is to be made of a rigid plastic material, however, any material whether rigid or resilient will be considered as being within the scope of this invention. For example, should tube 1 be of resilient material, then it is possible for the slit to deform inwardly as the wire portion of the hanger is forced into said tube. But when the clip 2 is positioned about said tube 1 as hereinafter described, the tube will be unable to be deformed in an outwardly direction sufficient to allow removal of said hanger, provided of course, that the slit is of smaller width than the diameter of said hanger. Said clip 2 comprises a short tubular member 4 having an elongated member 6 spaced apart from said short tubular member 4 by a spacing bar 5. Said bar 5 holding said elongated member 6 and said short tubular member 4 in a fixed position relative to one another. Said short tubular member 4 further having a longitudinal slit opposite said elongated member 5. Said clip 2 is ideally of a non-resilient plastic material and has a slit of sufficient width to allow the wire of said hanger to slip through.

However, any non-resilient material is sufficient. Even resilient material would suffice so long as the pliability thereof does not allow the clip 2 to slip laterally from about tube 1.

Figure 2:
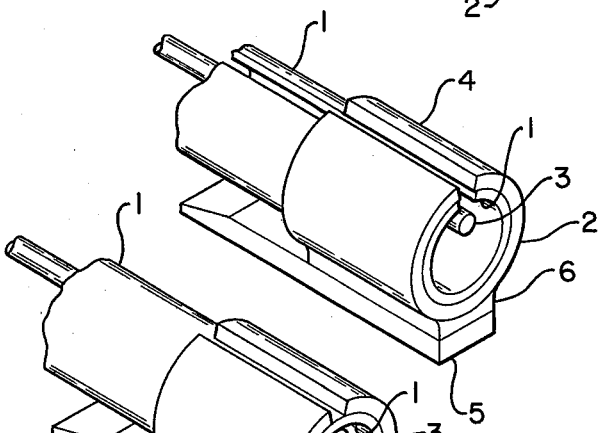
FIG. 2 is a perspective view of the end of said clip and said tube showing their juxtaposition for insertion of said wire hanger.
Figure 3:
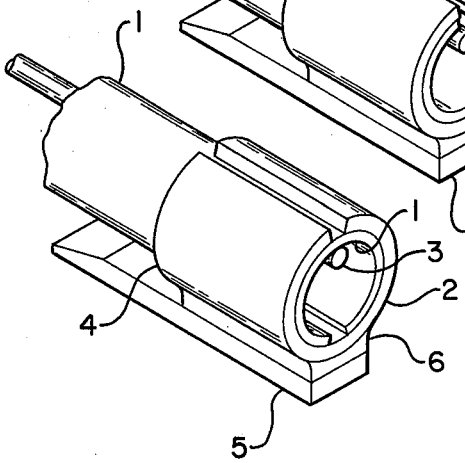
FIG. 3 is a perspective view of the end of said clip and said tube showing their juxtaposition for prevention of the removal of said wire hanger.
Figure 4:
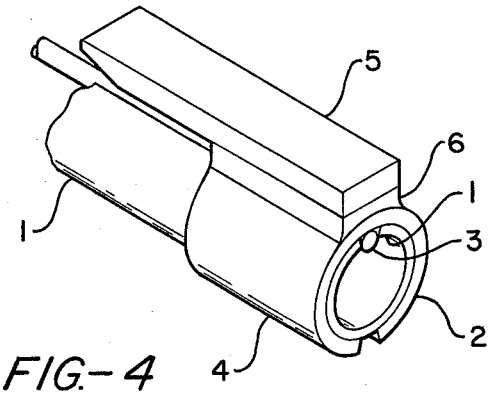
FIG. 4 is a perspective view of hanger registered in tube slit and clip in upright position.

Accordingly, with the combined structure as described, the tubular portion of clip 2 may be inserted over the end of said tube 1 as shown in FIG. 2. When the slit of clip 2 and the slit of tube 1 are aligned, the entire structure may be attached to hanger 3 by sliding the lower wire hanger portion 3 through both slits. The user may then rotate tube 1 relative to clip 2 thereby placing said slits in non-alignment and preventing removal of said hanger portion 3 from the structure unless the process is reversed. It is contemplated that at least two such clips will be provided. One for each end of said tube. Said clips 2 snugly fit on said tube 1 and may be adjusted longitudinally thereof to accommodate different widths of the various clothing articles draped thereon.

Further, the tube 1 and clip 2 combination may be rotated as a unit and held in an upright position with said bottom hanger portion resting in the slot of said tube 1 but restrained from complete exit by said clip 2. Such a position will allow the clips 2 to be adjusted longitudinally but prevent the elongated portion 5 thereof to lay on its side against the clothes thereby avoiding wrinkles. Creases are still prevented because the slot of said tube is occupied by the wire of said hanger 3 and the large diameter of said tube 1 prevents creasing of said clothes as before due to a large diameter hanger apparatus supporting the clothes.

The foregoing is considered illustrative only of the principles and specific embodiment of the invention. Further, since numerous modifications and changes will readily occur to those skilled in the art, it is not intended to limit the invention to strictly that described herein but such is to include all modifications and equivalents falling within the scope of the invention herein claimed.

What is claimed is:

1. A clothes hanger adapter for a clothes hanger comprising:

(a) a first elongated hollow tube having a longitudinal slit therein for receiving the portion of said clothes hanger which supports clothes such that said portion is interior of and generally parallel to said first tube, and (b) at least one second hollow tube substantially equal in inside dimensions to the outside dimensions of said first tube also having a longitudinal slit axially receiving said first tube such that said slits are parallel and said first tube is rotatable about said second tube so as to selectively place said slots into and out of complete registry, *w* hereby said clothes hanger portion which supports clothes may be inserted into said first and second tubes when said slits are reigstered and whereby removal is prevented when said first and second tubes are rotated relative to one another to take said slits out of complete registration.

2. A clothes hanger adapter as described in claim 1 wherein said second tube has (a) an elongated L shaped clip attached to said second tube having one arm thereof parallel to said tube for engaging clothes hung on said adapter.

3. A clothes hanger adapter as described in claim 2 wherein:

(a) said second tube is made of a non-resilient material, and (b) said slit therein is sufficiently wide to receive said wire hanger.

4. A clothes hanger adapter as described in claim 3 wherein:

(a) said first elongated hollow tube is made of a non-resilient materials, and (b) said slit therein is sufficiently wide to receive said wire hanger.

5. A clothes hanging adapter as described in claim 1 wherein said second tube is adjustable longitudinally of said elongated member.

6. A clothes hanger adapter for a wire hanger comprising:

(a) an elongated tubular member having a longitudinal slit therein for receiving the wire portion of said hanger internally thereof shorter than said wire portion, and (b) means for preventing removal of said hanger from said tubular member.

7. A clothes hanger adapter as described in claim 6 wherein said means for preventing removal of said hanger comprises:

(a) a short tubular member, having a longitudinal slit therein, which receives said elongated tubular member and whose inside diameter is equal to the outside diameter of said elongated tubular member.

8. A clothes hanger adapter as described in claim 7 wherein said means is adjustable longitudinally of said elongated tubular member and rotatable transverse of said elongated member.

9. A clothes hanger adapter as described in claim 8 wherein said means further comprises:

(a) a spacer integral with said short tubular member opposite said slit, and (b) an elongated bar integral with said spacer opposite said short tubular member.

10. A clothes hanger adapter comprising:

(a) a first tubular member having a longitudinal slit therein for receiving the lower portion of a clothes hanger and of greater diameter than the lower portion of said clothes hanger, (b) a second tubular member, shorter than one half the length of said first tubular member having a longitudinal slit therein, of greater outside diameter than the outside diameter of said first tubular member slideably and rotatably receiving said first tubular member, (c) a spacer integral with said second tubular member and attached remote from said slit, (d) an elongated member integral with said spacer and attached opposite said second tubular member and parallel to the longitudinal axis of said tubular member, whereby said second member may be adjusted longitudinally and rotated transverse of said first tubular member such that said clothes hanger cannot be removed from said slot.

* * * * *